US007886994B2

(12) United States Patent
Martin et al.

(10) Patent No.: US 7,886,994 B2
(45) Date of Patent: Feb. 15, 2011

(54) NOZZLE FOR INTRODUCING AND METERING A TREATMENT MEDIUM INTO THE EXHAUST GAS STREAM IN COMBUSTION PROCESSES

(75) Inventors: Johannes Martin, München (DE); Dirk Hammler, Augsburg (DE)

(73) Assignee: Martin GmbH für Umwelt- und Energietechnik, München (DE)

( * ) Notice: Subject to any disclaimer, the term of this patent is extended or adjusted under 35 U.S.C. 154(b) by 181 days.

(21) Appl. No.: 11/821,887

(22) Filed: Jun. 26, 2007

(65) Prior Publication Data

US 2008/0035751 A1 Feb. 14, 2008

(30) Foreign Application Priority Data

Aug. 9, 2006 (DE) ..... 10 2006 037 369
Jan. 18, 2007 (DE) ..... 10 2007 003 665

(51) Int. Cl.

*F23D 11/10* (2006.01)
*F23D 11/16* (2006.01)
*F23D 14/62* (2006.01)
*B05B 7/06* (2006.01)
*B05B 7/04* (2006.01)

(52) U.S. Cl. ..... 239/419; 239/418; 239/421; 239/424; 239/425; 239/426; 239/432; 239/433; 239/434

(58) Field of Classification Search ..... 239/418, 239/419, 419.3, 421, 423, 424, 424.5, 425, 239/426, 429, 430, 431, 432, 433, 434, 434.5
See application file for complete search history.

(56) References Cited

U.S. PATENT DOCUMENTS 2,192,996 A * 3/1940 Fenzl ..... 239/431
3,245,622 A * 4/1966 McBride ..... 239/425
3,680,781 A * 8/1972 Lincoln ..... 239/431
3,693,886 A 9/1972 Conrad
3,747,860 A * 7/1973 Habers ..... 239/431
3,840,181 A * 10/1974 Vier et al. ..... 239/127
4,072,470 A * 2/1978 Tsuto et al. ..... 422/242
4,655,395 A * 4/1987 Cioffi et al. ..... 239/427
4,784,328 A * 11/1988 Skraba ..... 239/432
5,188,296 A * 2/1993 Duez et al. ..... 239/403

(Continued)

FOREIGN PATENT DOCUMENTS

DE 2 163 098 7/1972

(Continued)

*Primary Examiner*—Len Tran
*Assistant Examiner*—Ryan Reis
(74) *Attorney, Agent, or Firm*—Collard & Roe, P.C.

(57) ABSTRACT

The nozzle for introducing and for metered addition of a treatment medium into the exhaust gas stream in combustion processes comprises a nozzle tube (2) and an inner displacement body (1) having a round cross section to form a nozzle ring gap (14). The displacement body (1) borders a mixing chamber (18) inside the nozzle tube (2) and on this end has a tapered area (3) with which it is held exclusively on a feed tube (5) for the treatment medium. The feed tube (5) crosses through a pressure chamber (6.1), which has two axial bordering walls (4, 7). The feed tube is held in these bordering walls, with a holder (12) being provided in the bordering wall (4), allowing the carrier medium from the pressure chamber (6.1) to flow through to the nozzle gap (14).

12 Claims, 2 Drawing Sheets

Figure 1:
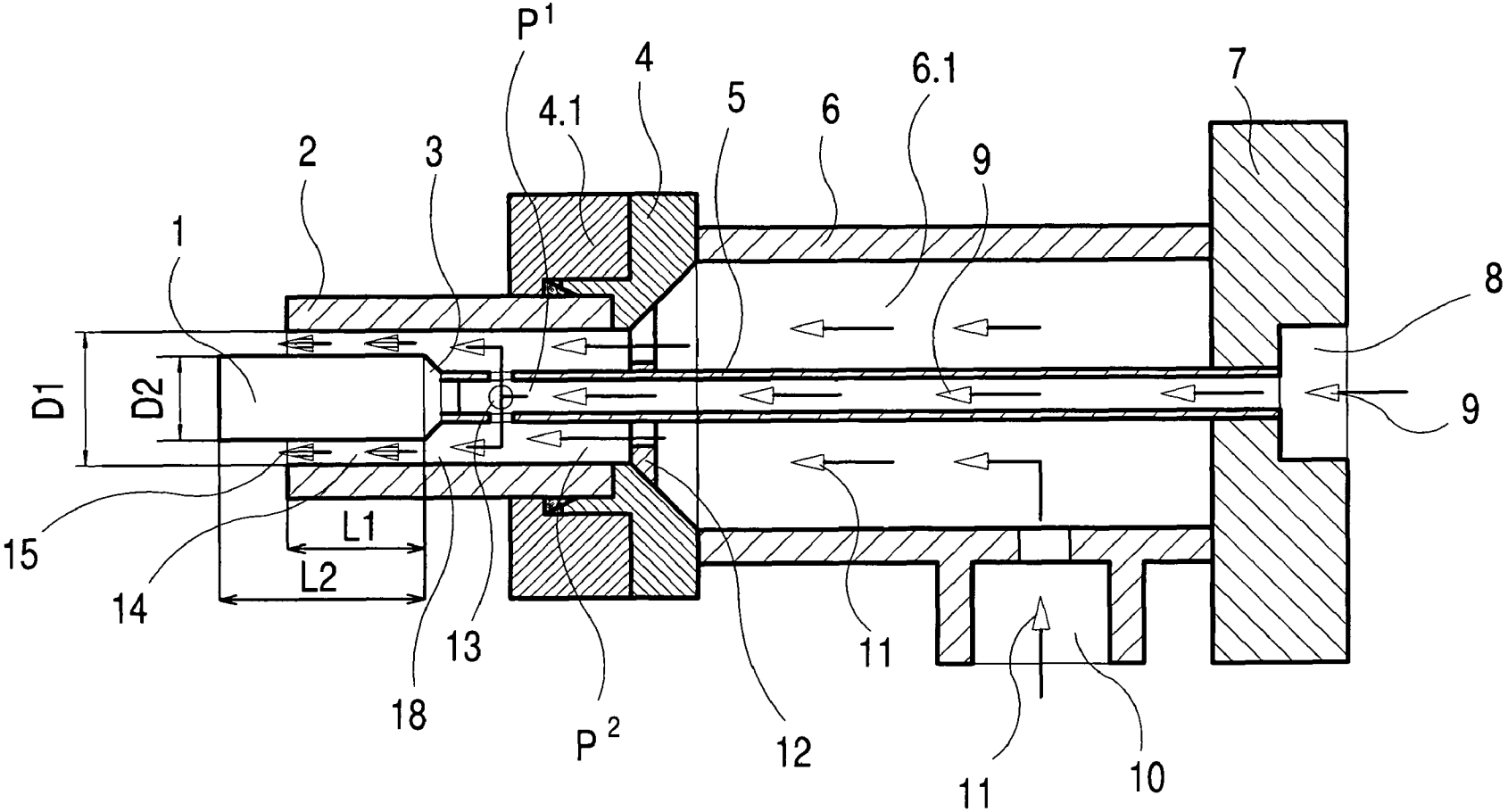

U.S. PATENT DOCUMENTS 5,256,375 A * 10/1993 Morris ..... 422/101
5,431,343 A * 7/1995 Kubiak et al. ..... 239/105
6,669,115 B2 12/2003 Sun et al.

FOREIGN PATENT DOCUMENTS

DE 22 52 218 5/1973
DE 393 5401 C 6/1991
DE 103 04 386 8/2004

* cited by examiner

NOZZLE FOR INTRODUCING AND METERING A TREATMENT MEDIUM INTO THE EXHAUST GAS STREAM IN COMBUSTION PROCESSES

CROSS REFERENCE TO RELATED APPLICATIONS

Applicants claim priority under 35 U.S.C. §119 of German Application No. 10 2006 037 369.3 filed Aug. 9, 2006 and of German Application No. 10 2007 003 665.7 filed Jan. 18, 2007.

The invention relates to a nozzle for introducing and metering a treatment medium into the exhaust gas stream of combustion processes, in which a treatment medium and a carrier medium can be mixed together and atomized jointly. The invention also relates to a method for operating such a nozzle.

DE 3935401 C1 describes an injection nozzle in which the treatment medium and the carrier medium can be introduced into a mixing chamber and atomized by means of a nozzle head having a nozzle bore. One disadvantage of this nozzle is the fact that the nozzle head is exposed to strong heating and corrosion effects in the combustion chamber.

The object of the present invention is to create a nozzle of this type, which is better able to withstand the stresses in the combustion chamber and can be restored to operating condition again easily in the event of wear.

Starting from a nozzle of the type defined in the preamble, This object is achieved according to this invention by the fact that the nozzle has an outer casing element and an inner displacement body to form a nozzle gap; the displacement body borders a mixing chamber inside the casing element and has a tapered area in the transitional area between the mixing chamber and the nozzle gap, said mixing chamber communicating with a pressure space for the carrier medium from which the carrier medium flows to the nozzle gap so that it is parallel with the axis. A feed element is provided for the treatment medium, such that the treatment medium escapes into the mixing chamber; the two media enter into the nozzle gap, which serves as the mixing zone, after being accelerated through the tapered area, and the displacement body has the same length as the casing element in the direction of the nozzle outlet.

Since the casing element is cooled from the inside by a mixture of carrier medium and treatment medium, it is capable of withstanding the high heat effects for a longer period of time. The inner displacement body may be arranged to be easily replaceable. When there is severe damage to the distal end of the casing element and the displacement body, these two parts may be shortened easily, assuming they were designed to be long enough originally, thereby rendering the nozzle ready for operation again. In comparison with a known nozzle having a nozzle head and nozzle bore, this entails a substantial simplification in operation of such a nozzle, because a single-substance nozzle having a specially coordinated nozzle outlet opening becomes clogged more easily but it cannot be cut off at its distal end as easily as is the case with the inventive nozzle.

According to an advantageous embodiment, the outer casing element and the feed element are round tubular elements.

An especially good mixing effect is achieved by the fact that the treatment medium enters the mixing chamber transversely, preferably perpendicularly to the direction of flow of the carrier medium.

For operation of the nozzle, it is advantageous if the displacement body protrudes beyond the casing element because this allows a favorable momentum effect to be exerted on the direct core area in front of the nozzle.

In another embodiment of this invention, the displacement body is arranged replaceably with its tapered area on the distal end of the feed element for the treatment medium as seen in the direction of flow as replaceably arranged there, running in the axial direction of the displacement body through the mixing chamber and having outlet openings for the treatment medium on the circumference in the vicinity of the tapered area. This creates a simple arrangement of the displacement body inside the nozzle tube, whereby in another embodiment of the invention it is especially advantageous if the displacement body is held exclusively by the feed pipe. In this way deviations in the centering of the displacement body within the casing element may result but they do not have any effect on the throughput or momentum in front of the nozzle because the free cross section available for outflow of the mixture is not affected by an oblique arrangement of the displacement body.

A simple embodiment in terms of the design is obtained when the feed element for the treatment medium runs centrally through the pressure space and connects the two axial bordering walls together, and the bordering wall assigned to the mixing space has a holder for the feed element that is permeable for the carrier medium.

If the casing element is made of a heat-resistant material, this prolongs the lifetime.

It is advantageous if the casing element is connected to the bordering wall via a detachable connection.

The present invention also relates to a method for operating such a nozzle and is characterized in that the throughput of the mixture of carrier medium and treatment medium and the momentum of this mixture in the core area and in the near area of the nozzle mouth can be regulated by varying the ratio of the inside diameter of the casing element and the outside diameter of the displacement body, by varying the ratio of the static pressure of the carrier medium and the total pressure of the treatment medium at the outlet from the feed element and by varying the length of the mixing zone of the two media.

The present invention is directed to a nozzle for the introduction and metered addition of a treatment medium into the exhaust gas stream during combustion processes, in which a treatment medium and a carrier medium can be mixed together and sprayed out jointly, wherein the nozzle exhibits an outer casing element and an inner displacement body to form a nozzle gap, wherein the inner displacement body is cylindrical, and the outer casing element is a round tubular element, said inner displacement body having a length L2, partially extending into the outer casing element over a length L1 and partially protruding from the outer casing element to form the nozzle gap; and the nozzle gap spanning the entire length L1; and the cross section of the nozzle gap being constant along the length of the inner displacement body, wherein the displacement body exhibits a mixing chamber inside the casing element and a tapered area in the transitional area between the mixing chamber and nozzle gap, and the mixing chamber communicates with a pressure chamber for the carrier medium, out of which the carrier medium flows to the nozzle gap.

The present invention is explained in greater detail below on the basis of an exemplary embodiment. In the drawing are illustrated:

FIG. 1 a longitudinal section through a nozzle and

Figure 2:
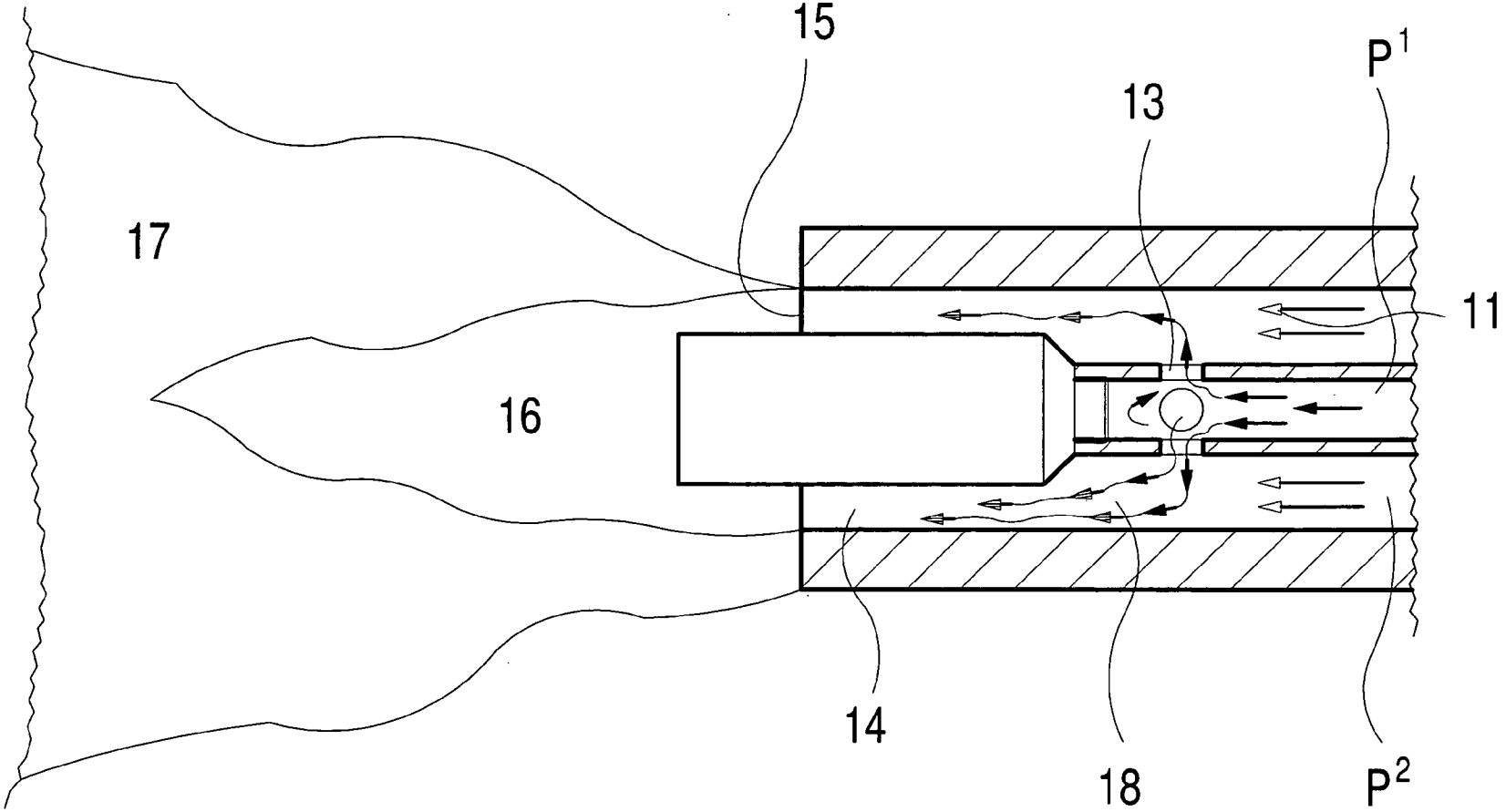

FIG. 2 an enlarged section of the front area of the nozzle according to FIG. 1.

As shown in the drawing, the nozzle has an outer casing element 2 and an inner displacement body 1 having a round cross section, having a length L2 and extending in to the casing element 2 over a length L1. In this way a nozzle gap 14 is bordered. The casing tube 4 is connected by means of a detachable connector 4.1, such as a nut, to a bordering wall 4.

The displacement body 1 has a tapered area 3 on its rear end with which it is connected to a feed element 5 for a treatment medium. This feed element 5 thus forms the holding device for the displacement body 1.

The feed element 5 is held in the bordering wall 4 of a pressure space 6.1 by means of a holder 12, which allows a carrier medium 11 to flow from the pressure space 6.1 to the nozzle gap 14. A rear bordering wall 7 of the pressure space 6.1 serves to hold the feed element 5. The pressure space 6.1 is bordered on its circumference by a tubular wall 6, which has an inlet opening 10 for a carrier medium 11.

Between the holder 12 and the bordering wall 4 and the tapered area 3, a mixing chamber 18 is provided, a carrier medium 11 flowing into it the axial direction at one end and on the other end a treatment medium 9 flowing out across the direction of flow of the carrier medium 11; this treatment medium is supplied by means of the feed element 5, which has outlet openings 13 on its end facing the tapered area 3, from which the treatment medium 9 flows out and begins to mix with the carrier medium. This process is continued in the nozzle gap 14.

If L2, the length of the displacement body 1, is greater than the depth of immersion L1 in the casing element 2, there is the possibility that when the distal end of this nozzle becomes clogged or destroyed, the distal end of the displacement body might be simply cut off by means of a disk cutter, so that operation of the nozzle can be begin again within a very short period of time.

The functioning of the nozzle is as follows:

The carrier medium 11 enters the pressure chamber 6.1 through the feed opening 10 and passes through the permeable holder 12 into the mixing chamber 18, going from there into the nozzle gap 14. The treatment medium 9 enters the feed element 5 and leaves it through the opening 13, so that it enters the mixing chamber 18 across the direction of flow of the carrier medium, preferably even at a right angle to it. The mixture undergoes acceleration through the tapered area 3, so that the mixing process is continued in the nozzle gap 14.

The diameter ratio of the inside diameter D1 of the nozzle pipe 2 and the outside diameter D2 of the displacement body 1 determines the throughput of the treatment medium and the carrier medium and the momentum in the core area 16 and in the near area 17 of the nozzle, like the ratio of the static pressure p2 of the carrier medium 11 and the total pressure p1 of the treatment medium at the outlet openings 13. The length of the mixing zone, starting from the mixing chamber 18 through the nozzle gap 14, has an influence on the throughput and the momentum, so that these parameters may be used to regulate the operation of the nozzle.

The invention claimed is:

1. A nozzle for the introduction and metered addition of a treatment medium (9) into the exhaust gas stream during combustion processes, in which a treatment medium (9) and a carrier medium (10) can be mixed together and sprayed out jointly, wherein the nozzle exhibits an outer casing element (2) and an inner displacement body (1) to form a nozzle gap (14), wherein the inner displacement body (1) is cylindrical, and the outer casing element (2) is a round tubular element, said inner displacement body (1) having a length L2, partially extending into the outer casing element (2) over a length L1 and partially protruding from the outer casing element (2) to form the nozzle gap (14); and the nozzle gap spanning the entire length L1; and the cross section of the nozzle gap (14) being constant along the length of the inner displacement body (1), wherein the displacement body (1) exhibits a mixing chamber (18) inside the casing element (2) and a tapered area (3) in the transitional area between the mixing chamber (18) and nozzle gap (14), and the mixing chamber (18) communicates with a pressure chamber for the carrier medium (10), out of which the carrier medium (10) flows to the nozzle gap (14).

2. The nozzle according to claim 1, wherein a feed element (5) for the treatment medium (9) is provided, from which the treatment medium (9) exits into a mixing chamber (18), wherein both media enter into a nozzle gap (14) serving as an additional mixing zone after accelerated in a tapered area (3).

3. The nozzle according to claim 1, wherein the displacement body (1) has at least the same length as the casing element (2) in the direction of a nozzle outlet.

4. The nozzle according to claim 1, wherein the outer casing element (2) and a feed element (5) are round tubular elements.

5. The nozzle according to claim 1, wherein the treatment medium (9) enters the mixing chamber (18) across the direction of flow, preferably at a right angle to the direction of flow of the carrier medium (11).

6. The nozzle according to claim 1, wherein the displacement body (1) protrudes beyond the casing element (2).

7. The nozzle according to claim 1, wherein the displacement body (1) with its tapered area (3) is arranged replaceably at the distal end of a feed element (5) for the treatment medium (9) as seen in the direction of flow, which runs through a mixing chamber (18) in the axial direction of the displacement body (1), and has outlet openings (13) for the treatment medium on the circumference in the vicinity of the tapered area (3).

8. The nozzle according to claim 1, wherein the displacement body (1) is held exclusively by the feed element (5).

9. The nozzle according to claim 1, wherein a feed element (5) for the treatment medium (9) runs centrally through the pressure chamber (6.1) and connects two axial bordering walls (4, 7) to one another, and that the bordering wall (4) assigned to the mixing chamber (18) has a holder (12) for the feed element (5) that is permeable to the carrier medium.

10. The nozzle according to claim 1, wherein the casing element (2) is made of a heat-resistant material.

11. The nozzle according to claim 1, wherein the casing element (2) is connected by a detachable connection (4.1) to a bordering wall (4).

12. A method for operating a nozzle according to claim 1, wherein the throughput of the mixture of carrier medium (10) and treatment medium (9) and the momentum of this mixture in the core area (16) and near area (17) of the nozzle mouth can be regulated by varying the length of the mixing zone of both media.

* * * * *